US005692934A

United States Patent [19]

Flury et al.

[11] Patent Number: 5,692,934

[45] Date of Patent: Dec. 2, 1997

[54] SWIMMING AID

[75] Inventors: Meinrad Flury; Maria Flury-Fuerboeck, both of Laupen, Switzerland

[73] Assignee: Joker AG, Switzerland

[21] Appl. No.: 647,973

[22] PCT Filed: Nov. 11, 1994

[86] PCT No.: PCT/IB94/00350

§ 371 Date: Jun. 3, 1996

§ 102(e) Date: Jun. 3, 1996

[87] PCT Pub. No.: WO95/15281

PCT Pub. Date: Jun. 8, 1995

[30] Foreign Application Priority Data

Dec. 3, 1993 [CH] Switzerland ..... 3611/93

[51] Int. Cl.[6] ..... B63C 9/08

[52] U.S. Cl. ..... 441/112; 441/118

[58] Field of Search ..... 441/88, 113, 114–119

[56] References Cited

U.S. PATENT DOCUMENTS

| | | | |
|---|---|---|---|
| 4,011,614 | 3/1977 | Bell . | |
| 4,131,974 | 1/1979 | Bolton et al. . | |
| 4,654,016 | 3/1987 | Pendleton . | |
| 5,060,661 | 10/1991 | Howard | 441/113 |

FOREIGN PATENT DOCUMENTS

| | | | |
|---|---|---|---|
| 5543 | 5/1906 | France | 441/112 |
| 438368 | 12/1926 | Germany . | |
| 2837497 | 3/1980 | Germany . | |
| 8900455 | 9/1990 | Netherlands . | |
| 98813 | 4/1923 | Switzerland . | |
| 21502 | 8/1915 | United Kingdom . | |
| 379445 | 9/1932 | United Kingdom . | |
| 2150084 | 6/1985 | United Kingdom . | |
| 9118786 | 12/1991 | WIPO . | |

*Primary Examiner*—Jesus D. Sotelo

*Attorney, Agent, or Firm*—Speckman, Pauley & Fejer

[57] ABSTRACT

A single inflatable ring-shaped body that can be drawn together and secured at the chest by a closure mechanism so as to form a neck loop and a back loop. The inflatable body can be subdivided into several air compartments, each of which can be inflated using an inflation nozzle.

8 Claims, 4 Drawing Sheets

SWIMMING AID

BACKGROUND OF THE INVENTION

1. Field of the Invention

This invention relates to a swimming aid, having a hose-shaped inflatable body placed against the body of a person wearing it, with at least one inflating nozzle, and a neck loop to be worn around the neck and forming at least one air chamber.

2. Description of Prior Art

The term swimming aid selected is to convey that this is intended to be an aid for a person actively engaged in water sports. This is in contrast to swim or life vests, which are subject to higher safety criteria and are essentially intended to assure great buoyancy. Reference is made to U.S. Pat. 4,654,016 for an example of such swim or life vests. In this case there is little or no design attention that would allow a person to engage in sports as much as possible and to be able to move.

The same can be said with respect to the floating aid in accordance with U.S. Pat. 4,131,974, which above all is intended to save a person wearing clothes. The inflatable floating aid has a neck loop with thickened ends, so that the entire structure has the shape of a letter omega. The floating aid is fastened and fixed in place on the body of the person wearing it by straps.

German Patent Reference 28,37,497 describes a swimsuit which, although described as a safety swimsuit, is hardly suited for engagement in sports, which has either an inflatable chest ring or a ring extending around the neck, as well as two float bodies extending under the arms of the swimmer. Besides the questionable freedom of movement, the appearance of this solution is hardly suited to induce a male or female swimmer to wear it continuously.

A swimming aid of the type mentioned at the outset is known from PCT Patent Reference WO 91/18786. The inflatable body is per se designed in a U-shape and divided into several chambers which each have an inflating nozzle. In this way the inflatable body which can be placed around the neck of the swimmer forms a neck loop, which can be drawn together by an upper closure and in the end is fixed on the body of the person wearing it with a second strap around the belly. Shorter, straight air chambers adjoin both sides of the neck loop and rest laterally against the body of the swimmer due to appropriate straps which cross on the back and are connected at the belly.

None of the known solutions is convincing as comfortable to wear, there is concern for simple manipulation and appearance. Swimming aids with various straps which can become twisted are not user-friendly and are not attractive. Too bulky structures limit mobility. This results in such known swimming aids not being worn, although they are useful per se by increasing safety.

Accordingly, it is one object of this invention to create a swimming aid which can be worn in an extremely simple way without straps, assures the greatest degree of freedom and takes esthetic requirements into consideration.

This object is attained with a swimming aid of the type mentioned at the outset which has the features of a neck loop, which makes a transition in one piece into a back loop and which can be fixed in the position of use by a closure mechanism. The closure mechanism holds the circular inflatable body, which is closed on itself in a ring shape, together in a chest area of the person wearing it.

The object attained by this invention is also particularly suited for children. An embodiment specifically suited for children is added to this as a characteristic essential for this invention, in that the closure mechanism has two closure parts which can be fixed in place at various distances by a length-adjustable member, but can only be conditionally released.

The swim vest in accordance with this invention cannot be opened inadvertently by a user so that the user slips out of the swimming aid. A further aspect is adaptation of the swimming aid to the size of a body of the user so that it is possible to achieve correct seating for each user even with only a few sizes.

Further advantageous embodiments of this invention are described in the following specification, making reference to the attached drawings wherein.

DESCRIPTION OF PREFERRED EMBODIMENTS

Figure 1:
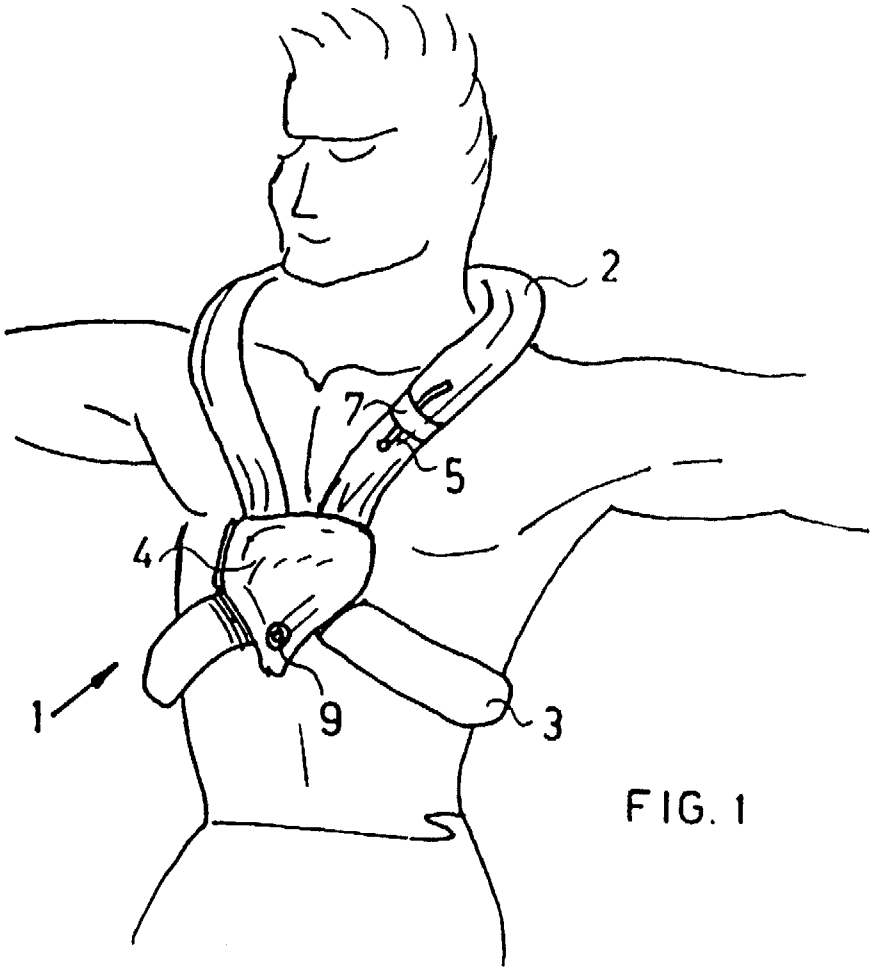
FIG. 1 shows a first embodiment of a swimming aid in a position of use, in a front view.
Figure 2:
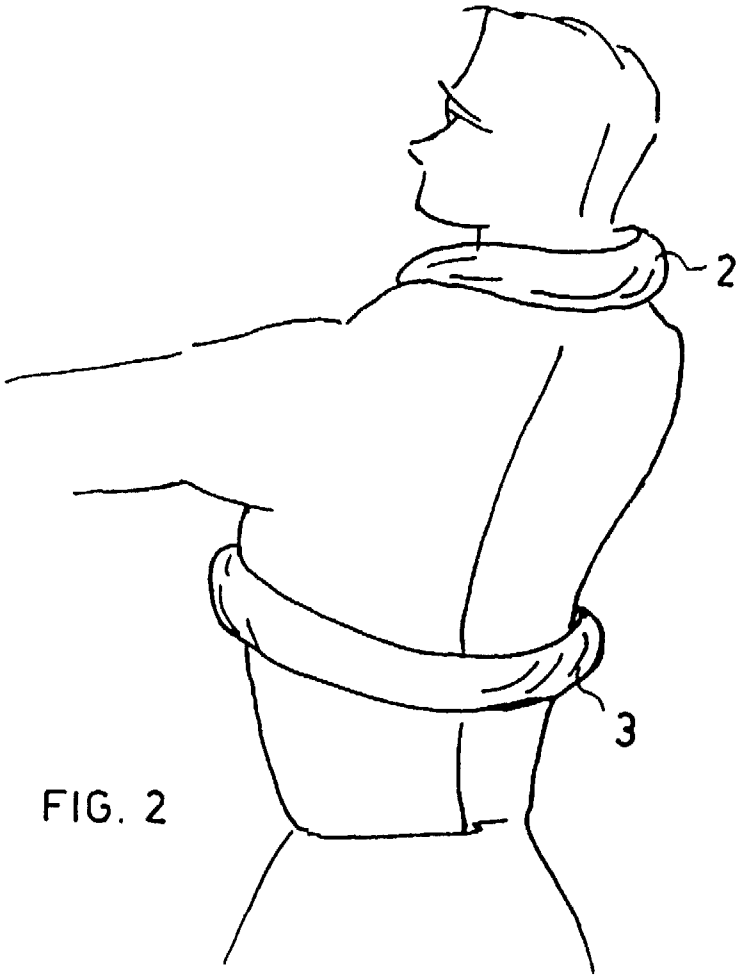
FIG. 2 shows the same swimming aid of FIG. 1 but in a rear view.

The swimming aid in accordance with this invention comprises an inflatable body, identified with element reference numeral 1. The inflatable body 1 may comprise a single air chamber, or may be divided into several partial air chambers, for safety reasons. However, the inflatable body 1 basically constitutes a single body closed on itself in a ring shape. This ring-shaped body can be drawn together at one point and fixed in place, so that the ring-shaped body then has a figure eight form, wherein an upper loop of the ring-shaped body forms a neck loop 2 and a lower loop forms a back loop 3. The ring-shaped inflatable body 1 is therefore only drawn together in the chest area of the person wearing it, so that the two described loops 2 and 3 are formed. The ring-shaped inflatable body 1 can be divided into several air chambers by means of weld seams extending transversely to the longitudinal direction in order to satisfy certain safety regulations. Naturally each partial chamber must have a separate inflating nozzle 5 in this case.

A closure mechanism 4 can be designed as a separate plastic element in the shape of a two-piece folding buckle by means of which the inflatable body 1 is squeezed or pulled together in the chest area. This squeezing or pulling together can occur in such a way that no air can circulate in the area of this buckle. In this case the closure mechanism 4 divides the inflatable body 1 into two separate air chambers which do not communicate with each other. The one partial air chamber then forms the neck loop 2 and the other partial air chamber the back loop 3. It is then sufficient to provide a single inflating nozzle 5. The inflating nozzles 5 are advantageously designed relatively long, so that the user can also inflate the inflatable body 1 when it is worn. So that the inflating nozzles 5 do not get in the way of the user, it is possible to provide holding flaps 7, under which the inflating nozzles 5 can be pushed. In this position the inflating nozzles 5 rest flat against the inflatable body 1. The holding flaps 7 can be freely movable elastic rings or also can be plastic foil strips welded at the edge areas 8. The closure mechanism 4 in FIG. 1 can for example be closed by means of a snap closure, which can be opened via a snap fastener 9. The buckle can be fixedly connected with the inflatable body 1 by welding or gluing.

Figure 3:
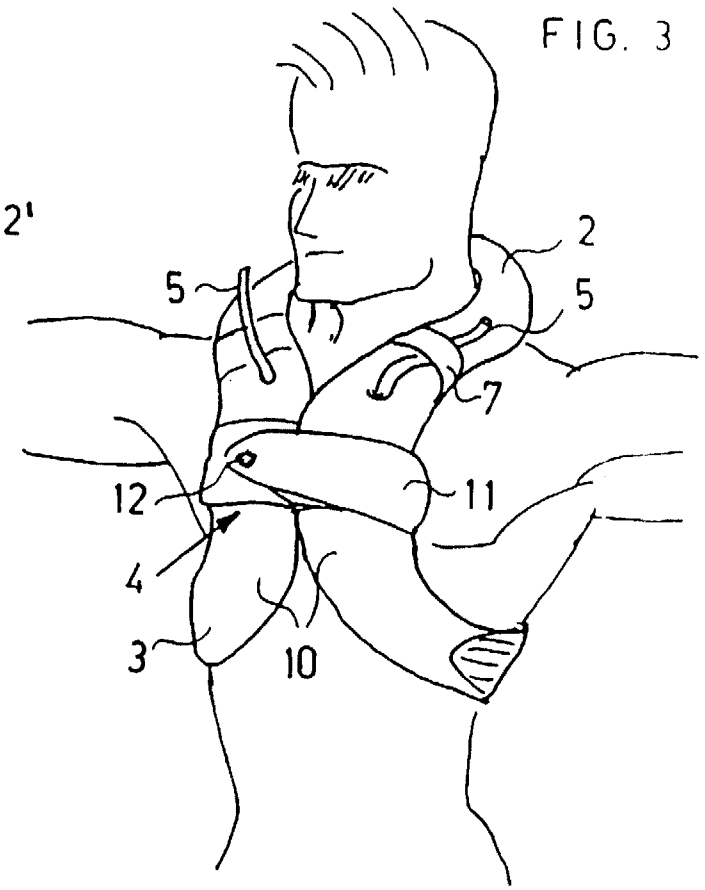
FIG. 3 shows a second preferred embodiment of the swimming aid, again in the state as worn, in a front view.
Figure 4:
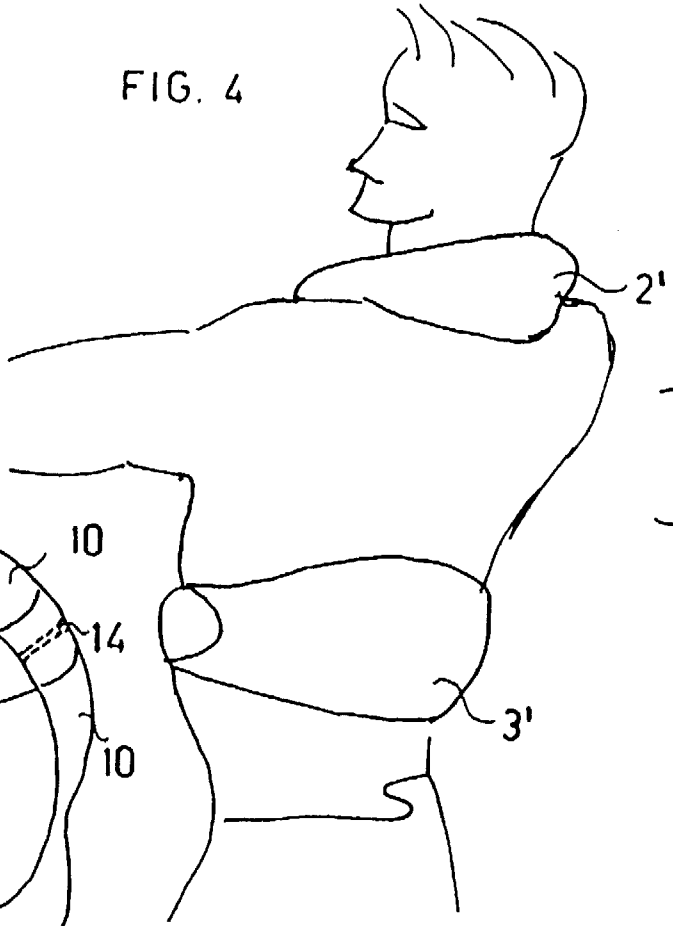
FIG. 4 shows a rear view of the swimming aid of FIG. 1.
Figure 5:
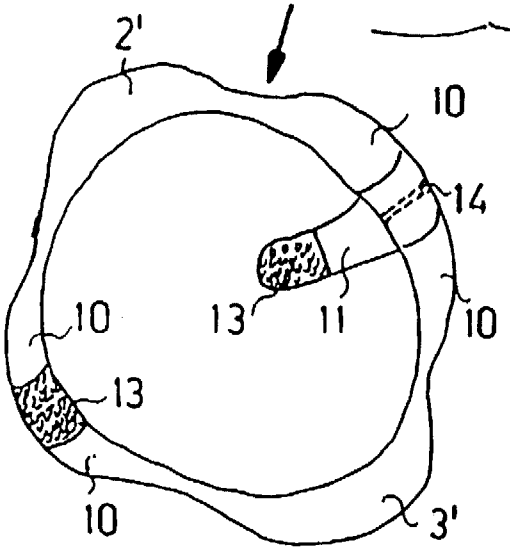
FIG. 5 shows the swimming aid in accordance with FIGS. 3 and 4 in the inflated, but not worn, condition.

In its general structure, the embodiment of the swimming aid in accordance with FIGS. 3–5 is completely identical with the previously described embodiment. Certain changes in design can be made which result in increased buoyancy without limiting the free movement which is already completely provided in the first described embodiment. The main changes are that both the neck loop 2 and the back loop 3 have an air chamber section 2' in the neck area and an air chamber section 3' in the back area which are widened in cross section. This design not only leads to a different esthetic design shape, but also leads to improved seating of the neck loop 2 and the back loop 3 on the respective parts of the body. In particular, they permit a flatter design without reducing buoyancy.

The inflatable body 1 can also be increased in the chest area by chest air chamber sections 10 of increased cross section. This cross-sectional increase is provided without increasing the application height on the body of the person wearing the swimming aid. The arm and underarm areas also remain completely free with this design and do not affect the freedom of movement of the user.

Here, the closure mechanism 4 has been designed in the shape of a tongue 11, which embraces the widened air chamber section 10 in the chest area and is held on it fixed in place and is long enough, so that the tounge 11 can embrace the second widened air chamber section in the opposite area. The closing fixation of the two widened air chamber sections 10 in the chest area takes place, for example, by means of a snap closure 12, as illustrated in FIG. 3, or with a Velcro™ or hook-and-loop closure 13, as illustrated in FIG. 5. With the embodiments of FIGS. 3–5 it is also possible to provide the division of the inflatable body 1 into partial air chambers by means of separating welds 14 directly in the area of the tongue 11, so that the welds 14 are no longer visible afterwards.

In addition to the described forms of the closure mechanism 4, other embodiments are naturally also possible. With a buckle- like design in accordance with FIG. 1, the closure mechanism 4 can also be integrally connected with the inflatable body 1. It is only essential that the inflatable body 1 comprises a continuous ring-shaped element of one or several air chambers, and that the fixation takes place exclusively by means of the closure mechanism 4 in the chest area. At the same time the design results in a shape which conforms to the shape of the body of the user but does not limit the user's freedom of movement.

While the designs of the shape of the closure described up to now are more suited to adults and permit complete release, two preferred embodiments are shown in FIGS. 6–11 which are also suited for children, because only a loosening and size adaptation of the swimming aid is possible by means of these closures, but not an unintentional complete release.

Figure 7:
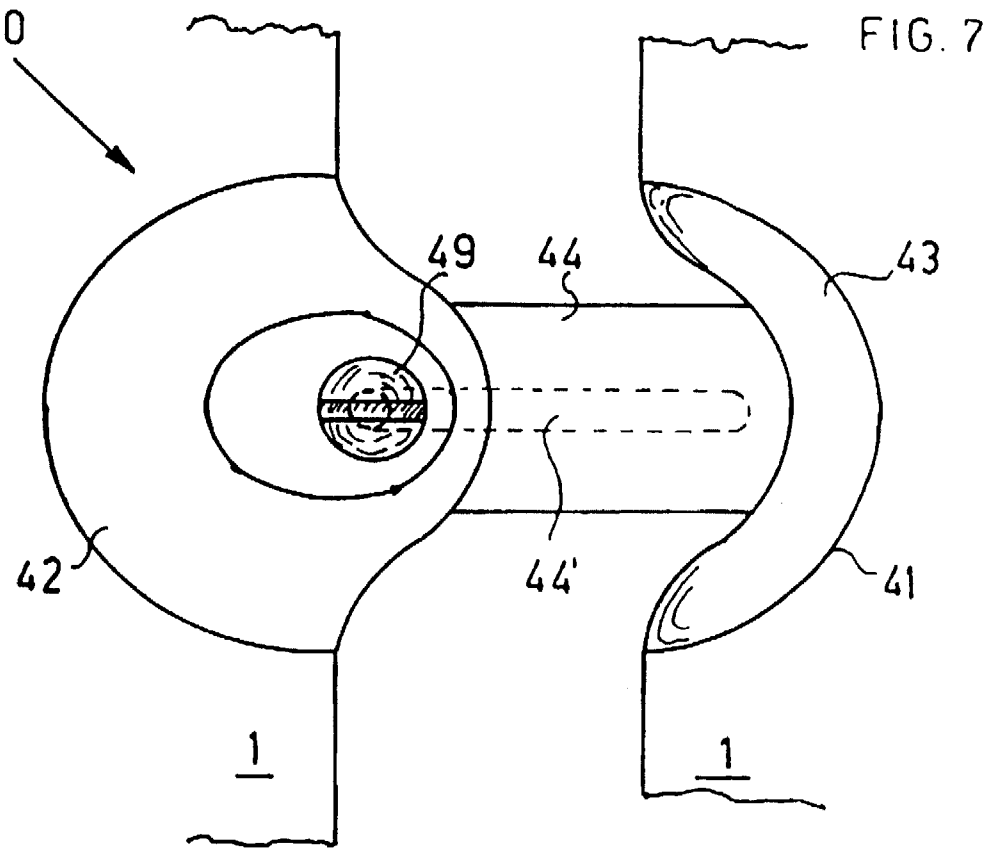
FIGS. 6–8 show a preferred closure as a part of the swimming aid of this invention, in the state where it is closed, opened as far as possible, and in section, respectively.
Figure 6:
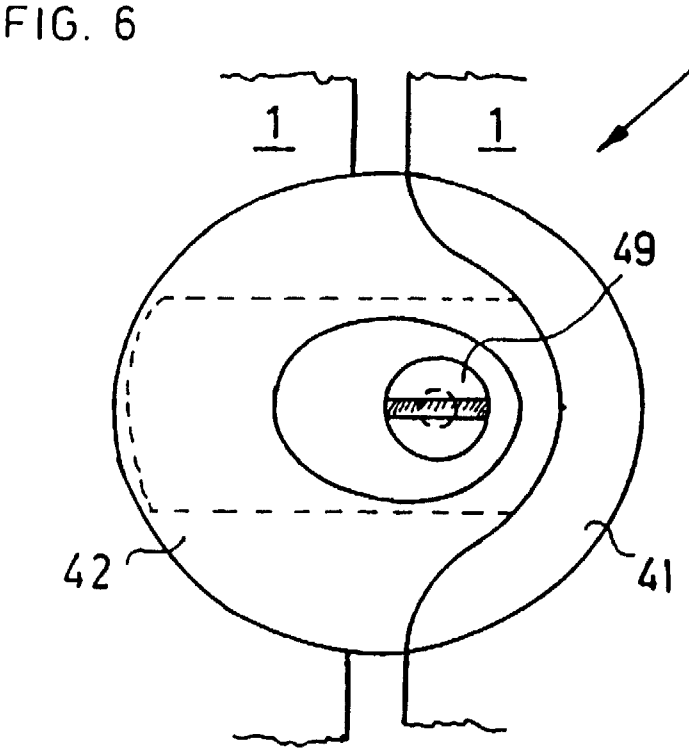
Figure 8:
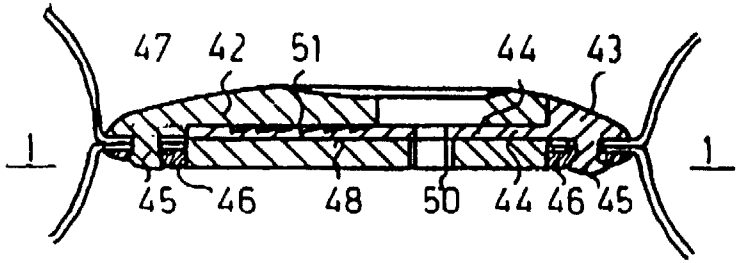

The embodiment of the lock 40 in accordance with FIGS. 6–8 comprises two closure parts, one of which forms a tongue part 41 and the other a buckle part 42. The tongue part 41 has an arcuate support edge 43, which is connected in one piece with the tongue 44 and is made of plastic, the same as all other parts of the closure. Several fastening nubs 45 are formed on an underside of the support edge 43. The fastening nubs 45 project through an edge area of the inflatable body 1 outside of the weld seam forming the chamber of the inflatable body 1. A correspondingly arcuate counter plate 46 can be pressed from the direction of the underside over the fastening nubs 45. Finally, the support edge 43 and the congruent or corresponding counter plate 46 together with the edge of the inflatable body can be welded together. The buckle part 42 is correspondingly designed with respect to fastening on the inflatable body 1. The buckle part 42 has a step-shaped recess 47 at the lower edge, which also has fastening nubs 45. These fastening nubs 45 also project through the edge area of the inflatable body 1 and an arcuate counter plate 46 is pressed over the fastening nubs 45 and subsequently welded. In this case the shape of the buckle part 42 is designed in such a way that it, together with the arcuate support edge 43 of the tongue part 41, results in a circular plate-shaped lock 40, as can be seen in FIG. 6, in the closed state. The body of the buckle part 42 can be produced in one piece or for reasons of manufacturing techniques preferably in two pieces. It has a centrally extending receiving slit 48 which is of such a size that the tongue 44 can slide in the slit 48. The tongue 44 can be arrested at least frictionally connected in any position in the buckle part 42 by means of a pressure screw 49. The screw 49 is designed such that it can be actuated with a coin. In the simplest case the screw 49 only presses the tongue on the base plate of the buckle part 42. As illustrated in FIG. 7, however, the tongue 44 can also have an elongated hole 44' which defines the maximum opening of the lock 40. In this case the screw 49 projects through the tongue 44, which is located between the upper plate and the base plate in the area of the receiving slit 48. Clamping by the screw 49 takes place by means of a thread 50 in the base plate.

A still different embodiment can have both the buckle part 42 in the area of the receiving slit 48 and the tongue 44 can have teeth 51, by means of which an interlocking as well as frictional connection is achieved.

Figure 10:
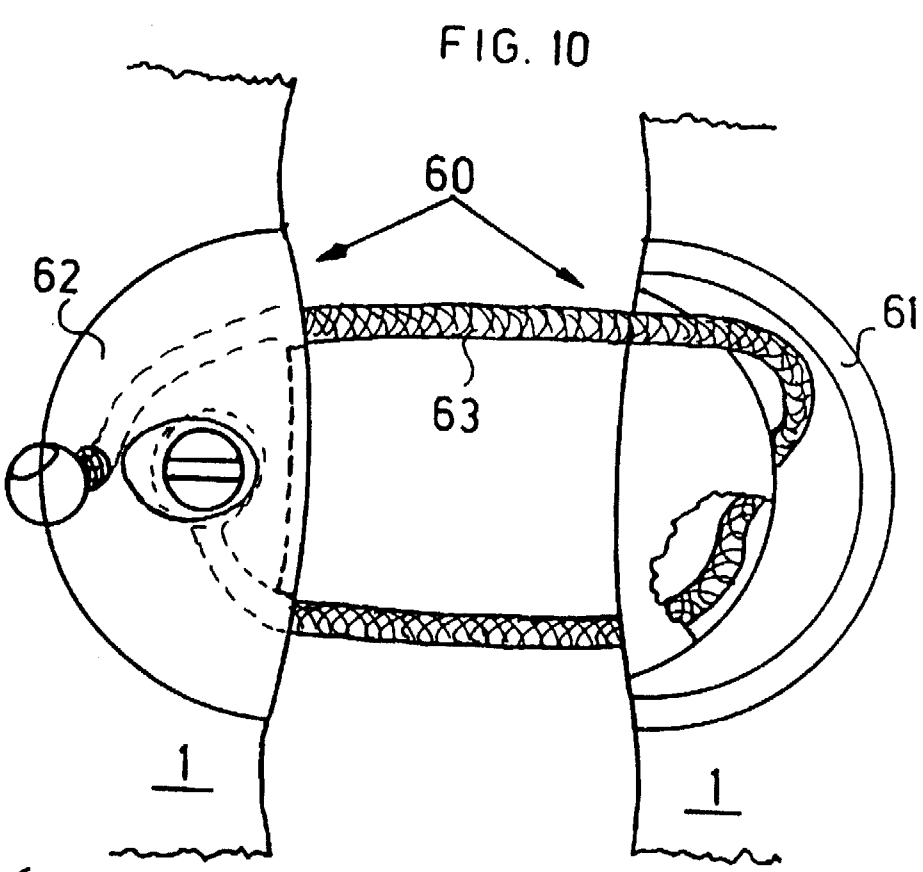
FIGS. 9–11 show, another embodiment of such a closure in the same three views.
Figure 9:
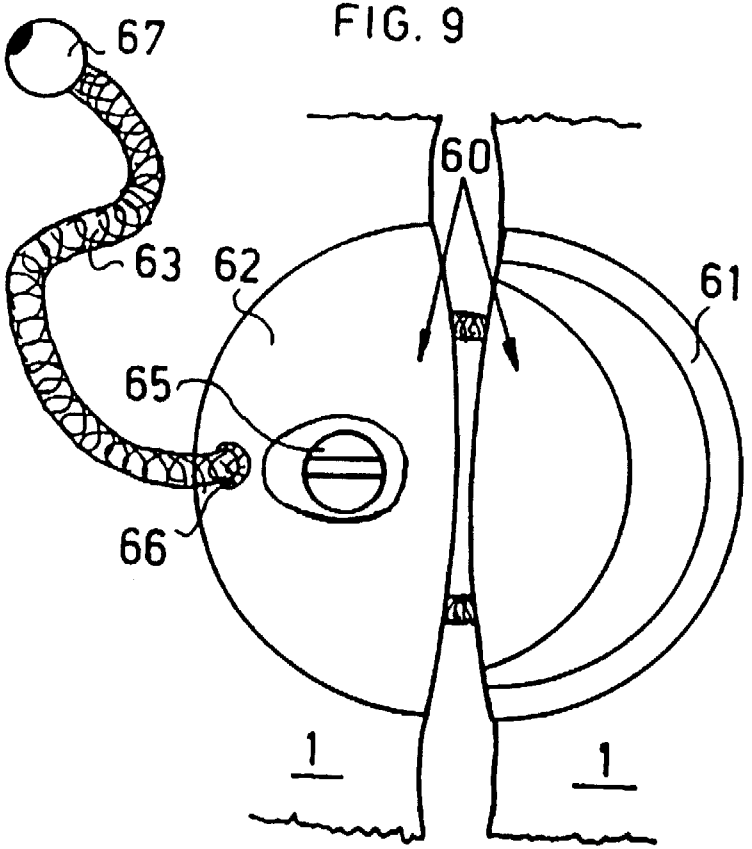
Figure 11:
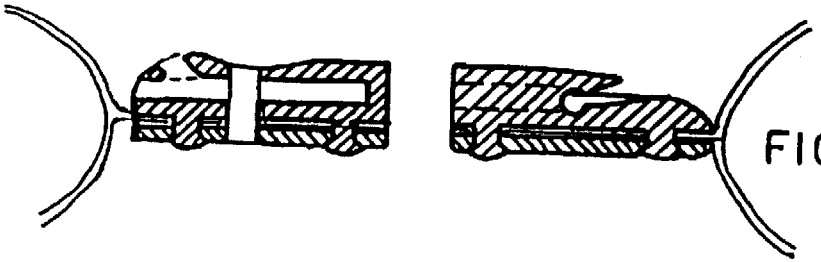

Yet another embodiment is shown in FIGS. 9–11. This lock 60 also comprises two closure parts, a lower part 61 and a clamping part 62. A string 63 connects the two closure parts 61, 62. The one end of the string 63 is held in the clamping part 62. Bridging the gap, the string 63 leads from the clamping part 62 to the lower part 61. A reversing groove 64 is located in the latter, extends in a semicircle and is shaped in such a way that the string 63 can be inserted through a narrowing. Again bridging the gap, the string 63 is brought back to the clamping part 62. The connection of the clamping part 62 and the lower part 61 with the inflatable body 1 takes place as in the previously described example by means of fastening nubs and a counter plate, wherein welding can again be provided.

In cross section the clamping part 62 is essentially C-shaped, wherein the vertical connecting strip is located between the upper cover face and the lower base face in the gap between the lower part 61 and the clamping part 62. The two faces mentioned can be pressed against each other by means of a clamping screw 65 and the string 63 extending between them and led out through an outlet opening 66 can be fixed in any position in this way. An end button 67 limits the opening space between the two closure parts 61, 62.

We claim:

1. A swimming aid comprising: a hose-shaped inflatable body (1) having at least one inflating nozzle (5) and a neck loop (2) forming at least one air chamber, which makes a transition as one piece into a back loop (3) and which can be fixed in a position with a closure mechanism (4, 11), the inflatable body (1) divided into a plurality of separate air chambers, the neck loop (2) having a first air chamber section (2') with a first widened cross section positioned at a rear neck area of a user wearing the swimming aid, and the back loop (3) having a second air chamber section (3') with a second widened cross section positioned at a rear back area of the user.

2. A swimming aid in accordance with claim 1, wherein in a chest area of the user the inflatable body (1) has a plurality of air chamber sections (10) each with a widened cross section.

3. A swimming aid in accordance with claim 1, wherein the closure mechanism (4) comprises a tongue (11) fastened on the air chamber section in a chest area of the user and which is sufficiently long to embrace the air chamber section (10) extending next to the tounge (11).

4. A swimming aid in accordance with claim 3, wherein the tongue (11) can be locked by at least one of a snap closure and a hook-and-loop closure.

5. A swimming aid in accordance with claim 1, wherein the closure mechanism (4) comprises a lock (40, 60) which keeps the air chamber sections (2') and (3') pulled together in a chest area of the user.

6. A swimming aid in accordance with claim 5, wherein the lock (40,60) is formed of two separate parts (41,42; 61,62) connected to the inflatable body (1).

7. A swimming aid in accordance with claim 6, wherein the one closure part, as a tongue part (41) with a tongue (44), which can be inserted in at least one of a frictionally connected and an interlocking manner into the other closure part as a buckle part (42), is fixed in one of a plurality of intermediate positions with a clamping screw (49).

8. A swimming aid in accordance with claim 6, wherein the one closure part is a reversing part (61) and the other closure part is a clamping part (62), wherein a string (63) is led from the clamping part (62) via the reversing part (61) back into the clamping part (62) and can be fixed in any one of a plurality of intermediate positions.

* * * * *